US008186189B2

(12) United States Patent
Brisco et al.

(10) Patent No.: US 8,186,189 B2
(45) Date of Patent: May 29, 2012

(54) LATCH ASSEMBLY

(75) Inventors: Donald Lee Brisco, Lake Elsinore, CA (US); Eryk Stacy, Silverado, CA (US)

(73) Assignee: Fleetwood Aluminum Products, Inc., Corona, CA (US)

( * ) Notice: Subject to any disclaimer, the term of this patent is extended or adjusted under 35 U.S.C. 154(b) by 799 days.

(21) Appl. No.: 12/079,874

(22) Filed: Mar. 27, 2008

(65) Prior Publication Data

US 2009/0241611 A1 Oct. 1, 2009

(51) Int. Cl.
*E05B 65/08* (2006.01)

(52) U.S. Cl. ..... 70/100; 70/99; 292/337

(58) Field of Classification Search ..... 70/95, 99, 70/100, 448, 450, 451, 452, 466, 208, 103; 292/337

See application file for complete search history.

(56) References Cited

U.S. PATENT DOCUMENTS

| | | | | | |
|---|---|---|---|---|---|
| 315,761 | A * | 4/1885 | Gerwien | 70/99 |
| 416,312 | A * | 12/1889 | Winchester | 70/99 |
| 723,239 | A * | 3/1903 | Butler | 70/100 |
| 739,903 | A * | 9/1903 | McKean | 70/99 |
| 810,927 | A * | 1/1906 | Emmert | 70/100 |
| 2,666,319 | A * | 1/1954 | Price | 70/97 |
| 2,736,185 | A * | 2/1956 | Collar | 70/100 |
| 2,789,852 | A * | 4/1957 | Eads | 292/110 |
| 2,802,685 | A * | 8/1957 | Duvall | 292/337 |
| 2,924,475 | A * | 2/1960 | Russell | 292/129 |
| 3,012,430 | A * | 12/1961 | Spork | 70/99 |
| 3,019,043 | A * | 1/1962 | Woodworth et al. | 292/113 |
| 3,065,985 | A * | 11/1962 | Du Four | 292/103 |
| 3,095,227 | A * | 6/1963 | Casebolt | 292/244 |
| 3,120,748 | A * | 2/1964 | Rechberg | 70/100 |
| 3,353,855 | A * | 11/1967 | Smith | 292/65 |
| 3,552,158 | A * | 1/1971 | Van Lengen | 70/483 |
| 3,633,389 | A * | 1/1972 | Horgan, Jr. | 70/120 |
| 3,740,979 | A * | 6/1973 | Crepinsek | 70/139 |
| 4,103,946 | A * | 8/1978 | Tipler | 292/114 |
| 4,643,005 | A * | 2/1987 | Logas | 70/95 |
| 4,790,157 | A * | 12/1988 | Lin | 70/95 |
| 5,722,704 | A * | 3/1998 | Chaput et al. | 292/26 |
| 5,935,224 | A | 8/1999 | Svancarek et al. | |
| 6,044,428 | A | 3/2000 | Rayabhari | |
| 6,052,740 | A | 4/2000 | Frederick | |
| 6,104,414 | A | 8/2000 | Odryna et al. | |
| 6,131,134 | A | 10/2000 | Huang et al. | |
| 6,282,929 | B1 * | 9/2001 | Eller et al. | 70/109 |
| 6,288,749 | B1 | 9/2001 | Freadman | |
| 6,356,968 | B1 | 3/2002 | Kishon | |
| 6,490,895 | B1 * | 12/2002 | Weinerman et al. | 70/208 |
| 7,373,794 | B1 * | 5/2008 | DePass | 70/99 |
| 2002/0135584 | A1 | 9/2002 | Lee | |
| 2003/0120849 | A1 | 6/2003 | Roslak et al. | |
| 2004/0017333 | A1 | 1/2004 | Cooper et al. | |
| 2004/0021615 | A1 | 2/2004 | Benson et al. | |
| 2006/0086161 | A1 * | 4/2006 | Johansson | 70/208 |
| 2009/0078011 | A1 * | 3/2009 | Avni | 70/486 |

* cited by examiner

*Primary Examiner* — Suzanne Barrett
(74) *Attorney, Agent, or Firm* — Vista IP Law Group LLP

(57) ABSTRACT

A door latch assembly having a latch mechanism and a substantially flush-mounted actuator. The actuator may raise and lower a latch within the latch mechanism to engage and disengage the strike plate of an adjacent door jam. Similar to the actuator, a key cylinder may be substantially flush-mounted on an opposite side of the door. The key cylinder may lock or unlock the assembly latch assembly latch assembly.

15 Claims, 7 Drawing Sheets

LATCH ASSEMBLY

FIELD OF THE INVENTION

This invention is generally related to latch assemblies, and more particularly to sliding door latch assemblies with actuators.

BACKGROUND OF THE INVENTION

Sliding doors come in many varieties and have numerous applications. In homes, they can be made of wood, glass, metals, and combinations of other materials. Such doors may allow access to backyards, closets and other rooms. Often, interior doors, such as closet doors, are hung from the top, while heavier doors, such as exterior patio doors, glide along a lower rail. In some cases, the doors may be configured to slide out of the way and into pocket walls.

A key element of a sliding door is the latch assembly. This assembly generally includes as latch mechanism and an actuator. The latch mechanism includes a latch that physically secures the door to an adjacent object such as a door jam. The actuator acts on the latch mechanism to lock and unlock the latch from as strike plate in the door jam. Existing actuators are typically unsightly as they protrude from the sliding door. These actuators may also catch clothing and other adjacent objects. Some latch assemblies also incorporate protruding hand pulls. The hand pulls may need more space to operate and may also catch on clothes or strike objects close to the door.

What is needed is a less-obtrusive latch assembly that retains the ability to secure and release the door in a user-friendly manner.

SUMMARY OF THE INVENTION

A latch assembly for use in connection with a sliding door includes an actuator and a latch mechanism. The actuator is recessed within at least one side of the sliding door. The actuator is coupled to the latch mechanism. The latch mechanism is positioned within a frame of the door. The latch mechanism includes a latch to engage an adjacent object such as the strike plate in a door jam to secure the door closed.

To lock the door, a user may first slide the door into a closed position such that the door's leading edge abuts an adjacent door jam. The user may then rotate the actuator into a closed position. The actuator acts on the latch mechanism, which acts on the latch. The latch may include a hook to engage a strike plate on the adjacent door jam. By engaging the strike plate, the latch locks the door into the closed position. To open the door, the user rotates the actuator in the opposite direction. The actuator acts on the latch assembly to disengage the hook of the latch from the strike plate of the door jam. The user may then slide the door open. A key cylinder may be installed opposite of the actuator for locking and unlocking the sliding door from the opposite side.

These and other aspects of the invention will become apparent from a review of the accompanying drawings and the following detailed description of the invention.

BRIEF DESCRIPTION OF THE DRAWINGS

The invention is generally shown by way of reference to the accompanying drawings in which:

FIG. 1 is a perspective view of a;

DETAILED DESCRIPTION OF THE INVENTION

Some embodiments are described in detail with reference to the related drawings of FIGS. 1 through 5B. Additional embodiments, features and/or advantages will become apparent from the ensuing description or may be learned by practicing the invention. In the figures, which are not drawn to scale, like numerals refer to like features throughout the description. The following description is not to be taken in a limiting sense, but is made merely for the purpose of describing the general principles of the invention.

Figure 1:
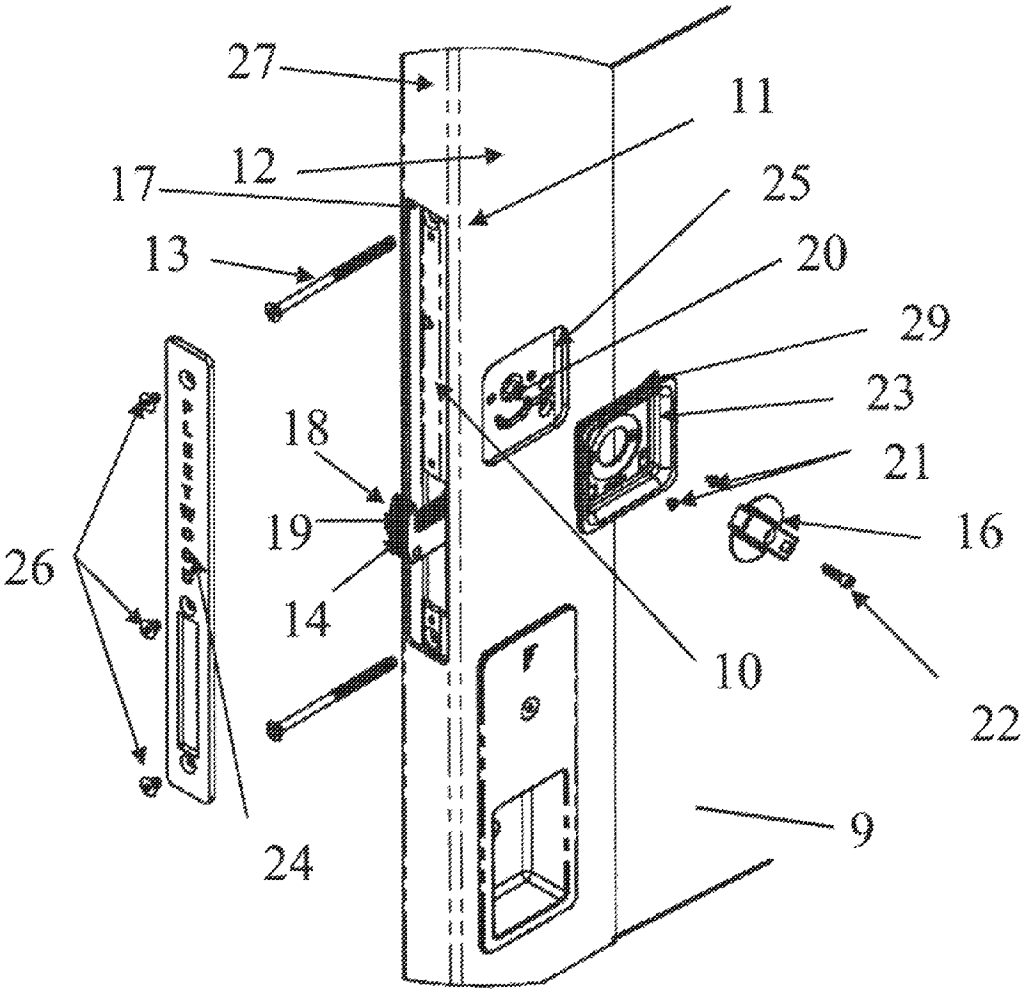

FIG. 1 illustrates one embodiment of a latch assembly 10 housed in the frame 11 of a sliding door 12. In addition to the door frame 11, the sliding door 12 includes a door body 9 at least partly within the door frame. The latch assembly includes a latch mechanism 14 and an actuator 16 for operating the latch mechanism. The latch mechanism may be further up or down the frame from the actuator. In such cases, the latch mechanism is considered to be a distance from the actuator. A person of ordinary skill in the art would recognize that such a distance can be dictated by factors such as the location of the corresponding receiving area on a door jam. The latch assembly has essentially two positions—locked and unlocked. The latch mechanism has a latch 18 which may be raised and lowered by manipulation of the actuator to lock and unlock the door. The latch has a hook 19 thereon for engaging a strike plate of an adjacent object—such as a door jam—in a locking position. In this embodiment, the actuator has a rotational range of approximately 120 degrees between locked and unlocked positions.

Once closed, the user may lock the sliding door 12 by rotating the actuator 16 in a first direction to raise the latch 18 to engage a strike plate of an adjacent door jam. The latch and the strike plate interlock to secure the door closed. To unlock the sliding door, the actuator may be rotated in an opposite direction to lower the latch and thereby release the strike plate. After release, the sliding door may be opened. In an alternative embodiment, a latch may be lowered to engage a strike plate and lock the door, rather than raised as shown here. Similarly, to unlock the door, a latch may be raised rather than lowered.

The actuator 16 is housed within a pocket 23. The pocket is fit within a first recess 25 in one side of the sliding door 12 and affixed to the sliding door with two screws 21. The pocket lies substantially flush with the side of the sliding door. In this embodiment, a pocket lip 29 protrudes approximately ⅛" from the sliding door. This near-flush fitment allows the sliding door to slide past adjacent panels or into a pocket wall. In other embodiments, this protrusion may be suitably altered including, but not limited to, a recessed fitting, flush mount or a larger protrusion. The pocket's recessed fitment here shields the actuator from inadvertent contact with clothing and other adjacent objects. In other embodiments, the pocket may be molded into the door frame.

The pocket and actuator are set back from the front edge 27 of the sliding door 12 to provide clearance between the door jamb and the actuator 16 for easy manipulation. The actuator passes through the pocket 23 to affix to a square shaft flipper 20 through a screw 22. In another embodiment, the shaft flipper may be disposed a distance from the actuator. In such a case, the actuator could be, for example, higher or lower in the frame from the location of the shaft flipper. This would be understood to be a distance from the shaft flipper. A person of ordinary skill in the art would understand that the distance from the shaft flipper to the actuator could depend upon factors such as the ease of which a person of a particular height may access the shaft flipper. The square shaft flipper acts on internal components of the latch mechanism described below to raise and lower the latch 18 depending on the position of the actuator.

Still referring to FIG. 1, a front cover 24 is affixed into a second recess 17 in the front edge 27 of the sliding door 12. The front cover is recessed into the front edge such that when the door is closed, the entire front edge may uniformly abut the adjacent door jam. The latch mechanism 14 is secured to the sliding door 12 through the use of screws 13. The front cover is secured to the latch mechanism by screws 26. The latch 18 with the hook 19 thereon protrudes through the front cover for engaging the strike plate of the adjacent door jam.

Figure 2:
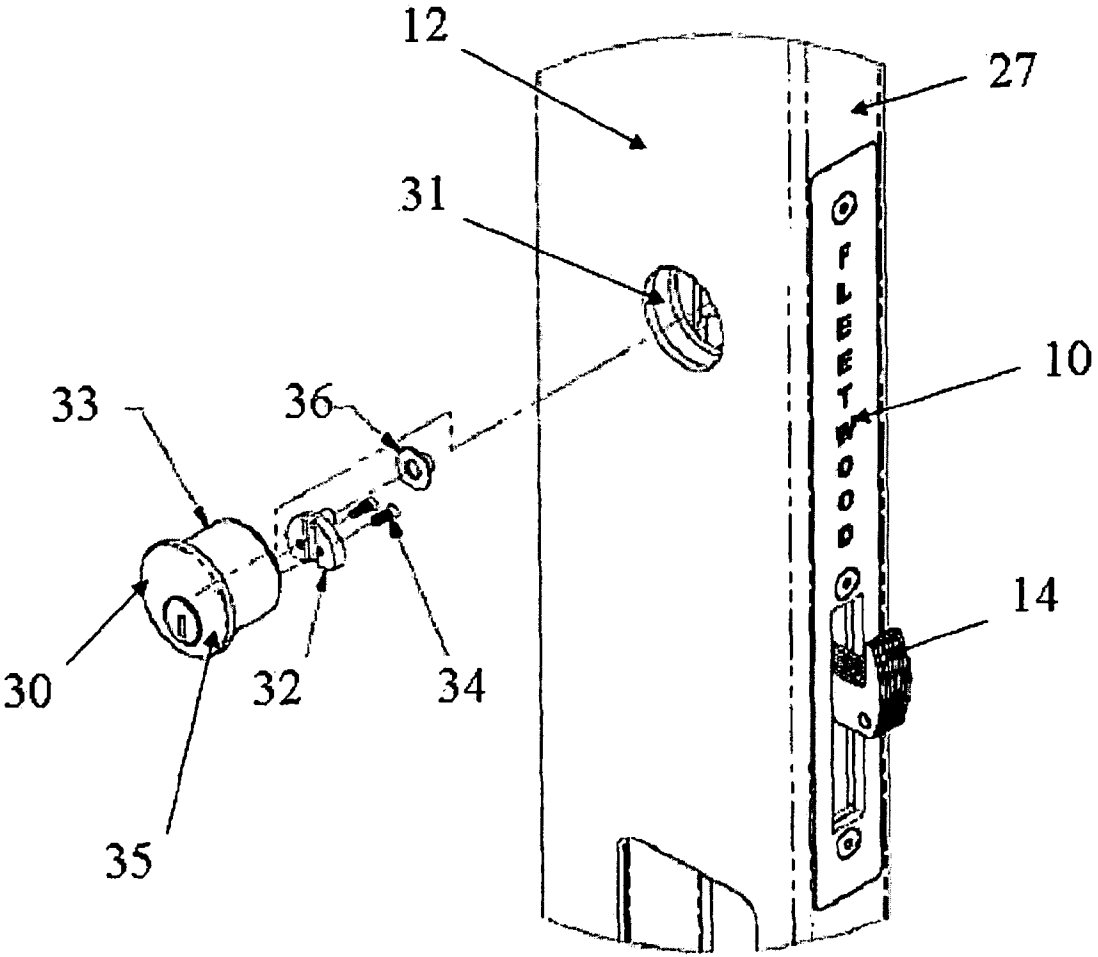
FIG. 2 is a perspective view of a key cylinder and the latch assembly.

Referring now to FIG. 2, a key cylinder 30 is located on the opposite side of the sliding door 12 from the actuator and at a higher position. The key cylinder has a key cylinder body 33 and a surface 35, and fits within a third recess 31 in the sliding door to lie substantially flush with the sliding door. In this embodiment, the surface of the key cylinder protrudes approximately ⅛" from the sliding door. This near-flush fitment allows the sliding door to slide past adjacent panels or into a pocket wall. In other embodiments, this protrusion may be suitably altered including, but not limited to, a recessed fitting, flush mount or a larger protrusion. Similar to the positioning of the actuator, the key cylinder is set back from the front edge 27 of the sliding door to provide clearance between the door jamb and the key cylinder for easy manipulation.

A cam 32 is fixed onto the end of the key cylinder through two screws 34. A first roller 36 is positioned on the end of the cam and configured to interact with the internal components of the latch mechanism 14. In operation, the key cylinder interacts with the cam and roller to lock and unlock the latch assembly 10—similar to the actuator locking and unlocking the latch assembly.

Figure 3:
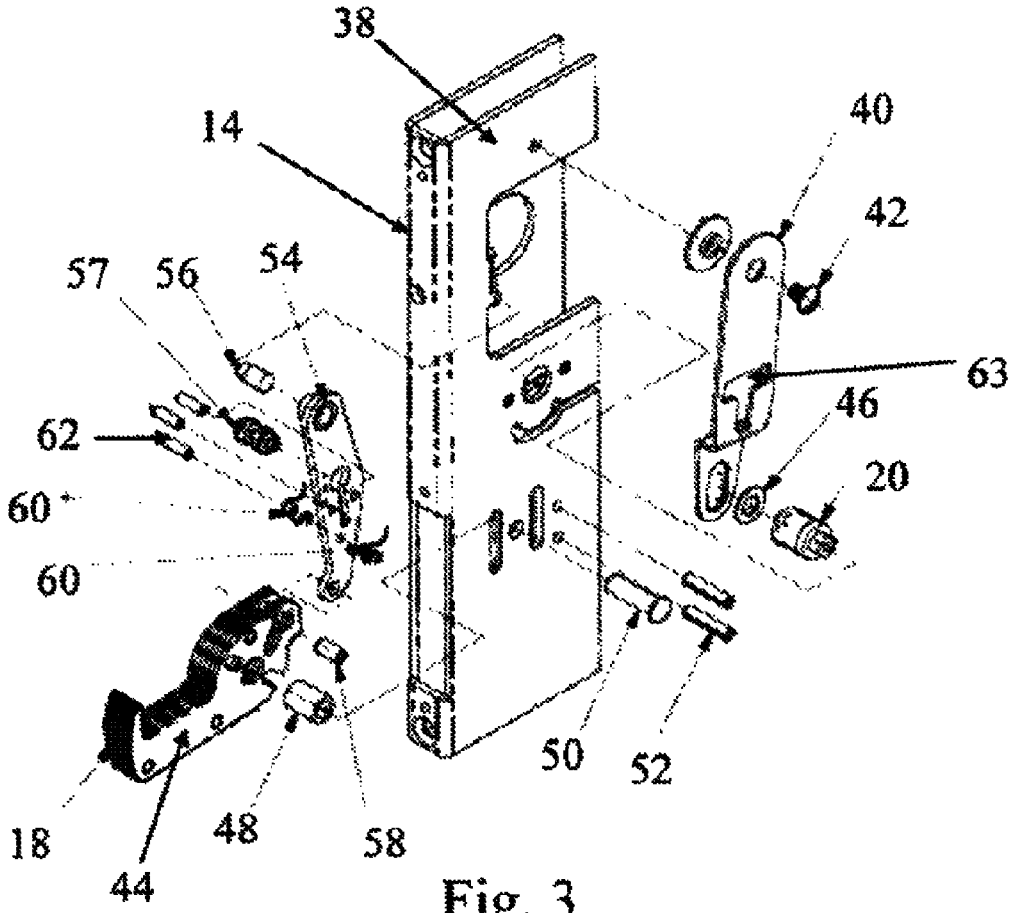
FIG. 3 is a perspective view of a latch assembly indicating the hook assembly.

Referring now to FIG. 3, the latch mechanism 14 includes a housing 38, latch 18, and a number of additional components therein. In particular, a backing plate 40 for securing the square shaft flipper 20 is affixed to the interior of the housing. A screw 42 and washer 44 couple the upper portion of the backing plate to the housing while the square shaft flipper and a roller 46 extends into the lower portion of the backing plate. An activating plate 47 (not shown) is affixed to the backside of the square shaft flipper. The activating plate interfaces with the backing plate on one end and an actuating arm 54 on the other.

The latch 18 is located within the housing and a sleeve 48 is positioned within the latch. A pin 50 is inserted through the housing and through the sleeve to allow the latch to pivot up and down. Locating dowels 52 positioned through the housing limit the upward and downward movement of the latch.

The actuating arm 54 controls the movement of the latch 18. The actuating arm is coupled to the housing 38 through pin 56 and coupled to the latch through pin 58. Springs 60 are secured to the actuating arm through pin 62 to provide the arm with a detent position. A cam pin 57 cooperates with the actuating arm. The key cylinder 30 (not shown) is coupled to one side of the actuating arm to rotate the actuating arm through a T-slot 63, the manipulation of the key cylinder ultimately raising and lowering the latch. Through interaction with the T-slot, once the latch is completely raised, the cam 32 and first roller 36 fall with the lower portion of the "T." Once positioned such that the latch is completely raised, the actuating arm, and therefore the latch, is fixed in a locked position. On the other side of the actuating arm, one end of the activating plate 47 (not shown) affixed to the square shaft flipper 20 interfaces with a second roller (not shown) coupled to the actuating arm to raise or lower the latch. At the same time, the other end of the activating plate rotates the backing plate 40 to rotate the key cylinder into corresponding locked or unlocked positions.

Figure 4:
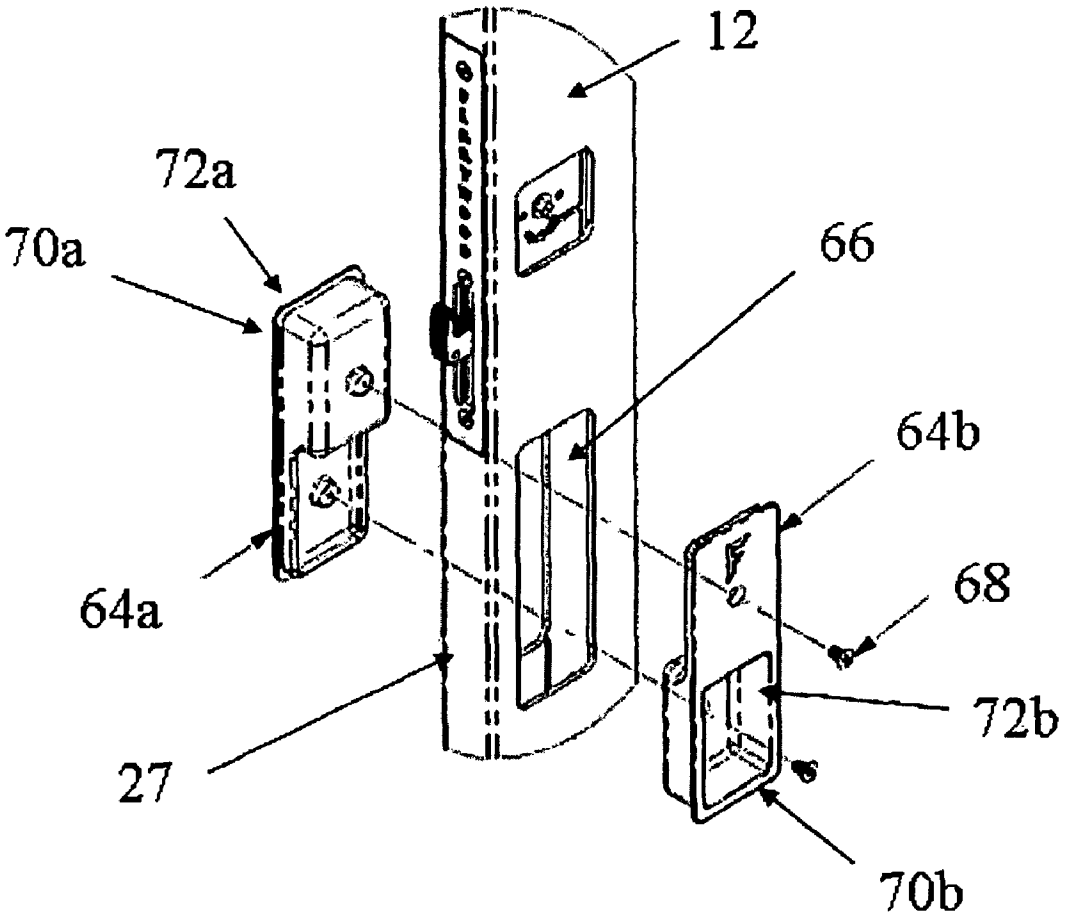
FIG. 4 is a perspective view of handpulls.

Referring now to FIG. 4, recessed hand pulls 64*a* and 64*b* are located within fourth recesses 66 in the sliding door 12 to lie substantially flush with the sliding door, similar to the near-flush placement of the actuator 16 and key cylinder 30. In this embodiment, hand pull lips 70*a* and 70*b* protrude approximately ⅛" from the sliding door. In this embodiment, the hand pulls are set back from the edge of the frame to provide additional clearance between the door jamb and actuator. This near-flush fitment allows the sliding door to slide past adjacent panels or into a pocket wall. In other embodiments, this protrusion may be suitably altered including, but not limited to, a recessed fitting, flush mount or a larger protrusion. Similar to the positioning of the actuator and key cylinder, the hand pulls are set back from the front edge 27 of the sliding door to provide clearance between the door jamb and the hand pulls for easy manipulation.

The hand pulls 64 are affixed to both sides of the sliding door 12 in an offset, interlocking relationship whereby screws 68 attach both hand pulls to each other. The offset arrangement, where one hand pull (64*a*) is oriented upwards and the other hand pull (64*b*) is oriented downwards, permits both hand pulls to have deep cavities for easy user manipulation. In this example, both hand pulls have cavities 72*a*, 72*b* approximately 1" deep, although in alternative embodiments this depth may be altered as necessary.

In operation, once the sliding door 12 is in the closed position, the actuator 16 may be rotated to lock the sliding door 12 from one side, or a key may be inserted into the key cylinder 30 to lock the door from the other side. To unlock the sliding door, either the key may be inserted and rotated in the opposite direction or, from the other side of the door, the actuator may be rotated in the opposite direction.

In alternative embodiments, a second latch can be added to increase security. The door itself can be constructed from a variety of materials included by not limited to, wood, metal, fiberglass, and composite materials. The door can be solid or incorporate glass, i.e., a sliding glass door. The door can also be configured for a variety of applications including, but not limited to, residential, commercial, marine, and recreational vehicle applications. The actuator, key cylinder, latch assembly, and hand pulls can be made out of a number of materials including, but not limited to, brass, aluminum, steel, stainless steel, and composites and be configured with a number of finishes depending on application.

Figure 5:
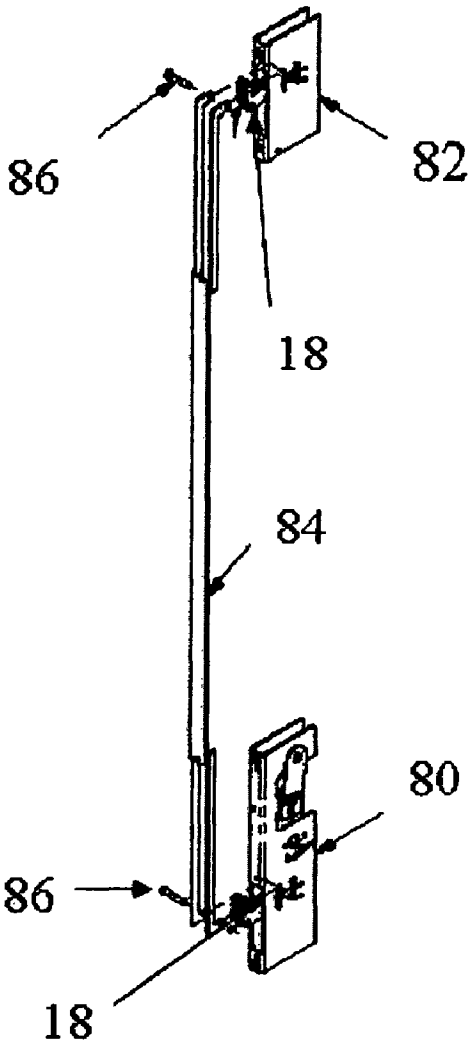
FIG. 5 is a perspective view of an embodiment having two latch assemblies.

Now turning to FIG. 5, a primary latch assembly 80, is connected to a secondary latch assembly 82. The latch assemblies work together to secure the door in place. It will be appreciated by one of skill in the art that two or more such assemblies can be combined and operate together or apart to secure the door in place. In this embodiment, the latch 18 of each assembly is operably connected by a linkage 84. Pins 86 connect the linkage 84 to the latches 18. It will also be appreciated by one of skill in the art that the linkage may be implemented in alternative embodiments is not limited to the illustration of FIG. 5.

Figure 5A:
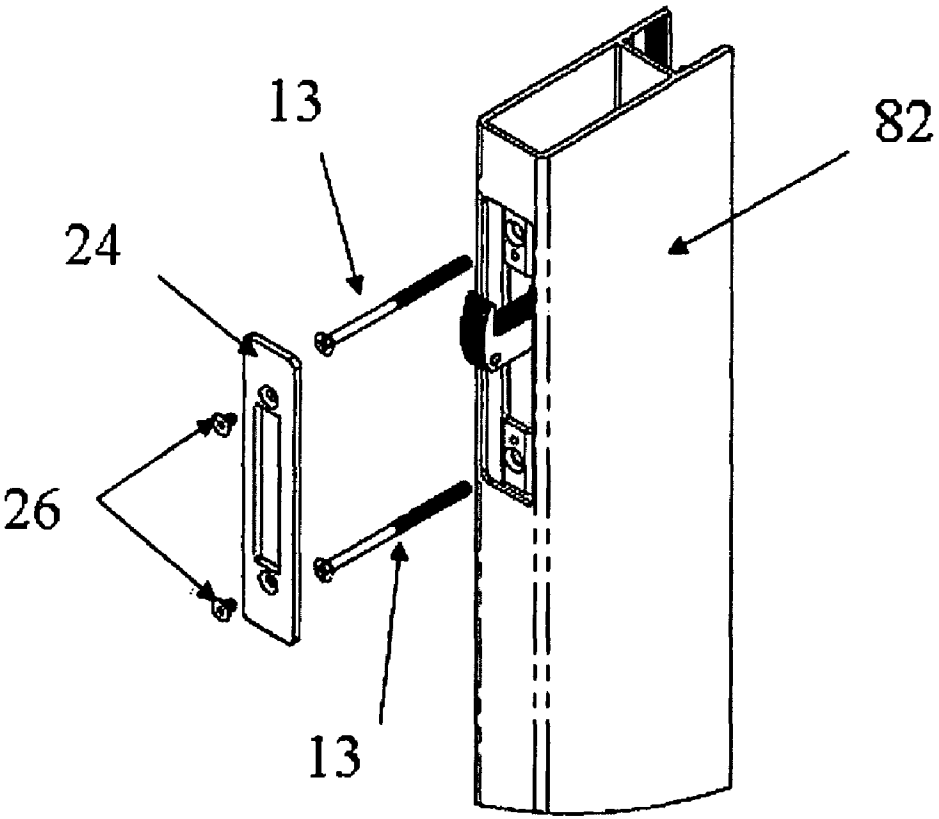
FIG. 5A is another perspective view of the secondary latch mechanism.
Figure 5B:
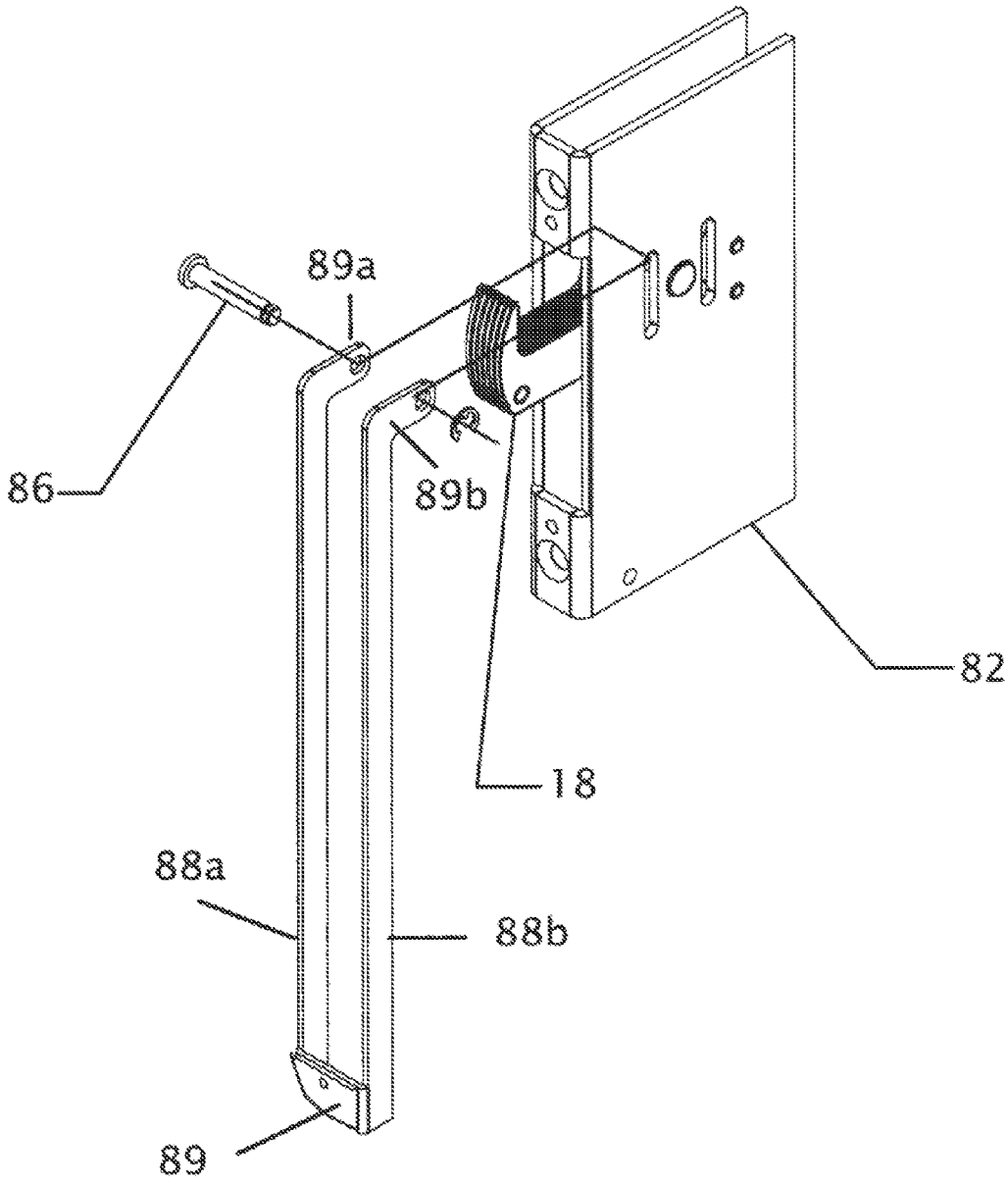
FIG. 5B is an enlarged perspective view of the upper latch assembly of the embodiment shown in FIG. 5.

Referring to FIG. 5A, in an alternative embodiment the secondary latch mechanism 82 is secured to the sliding door by two screws 13 at the top and bottom. The front cover 24 attaches to the latch mechanism with two screws 26 and is primarily used to provide an esthetically pleasing cover. The recess in the sliding door is larger than the latch and the cover was designed to fill the recess. FIG. 5B is an enlarged illustration of FIG. 5. In FIG. 5B, linkage 84 is provided with a flat bar portion, and projection 88*a*, 88*b* on either longitudinal side of the flat bar portion. Projections 88*a*, 88*b* further are provided with two "I"-shaped ears, dogs, or projections. The I-shaped ears 89*a*, 89*b* are configured to urge the flat bar portion 89 of the linkage away from secondary frame 82 and towards the door frame. This design has at least two advantages. First, the hollow area between the latches is kept clear of obstruction. This design also offers the second advantage of allowing for design aftermarket door handles to be used between the latches without affecting the functionality of the latching system. Accordingly, a wide degree of customization is opened to the consumer, well beyond what normally can be offered by one vendor.

While several embodiments have been described in detail, it should be appreciated that various modifications and/or variations may be made without departing from the scope or spirit of the invention. In this regard it is important to note that practicing the invention is not limited to the applications described herein above. Many other applications and/or alterations may be utilized provided that such other applications and/or alterations do not depart from the intended purpose of the invention. Also, features illustrated or described as part of one embodiment may be used in another embodiment to provide yet another embodiment such that the features are not limited to the embodiments described herein above. Thus, it is intended that the invention cover all such embodiments and variations as long as such embodiments and variations come within the latch assembly of the appended claims and its equivalents.

What is claimed is:

1. A latching structure for use with a door having a door frame, the latching structure comprising:

a primary latch assembly integrated with the door frame, the primary latch assembly comprising, a latch rotatable between a locked position in which the latch is in an extended position configured to engage the door frame and an unlocked position in which the latch is in a retracted position configured to be disengaged from the door frame;

a pivoting backing plate operably coupled to the latch such that pivoting of the backing plate causes the latch to rotate between the locked position and the unlocked position, the backing plate having a T-shaped slot formed by a crossing portion and a line portion intersecting the crossing portion;

a rotatable actuator operably coupled to a pivoting backing plate such that rotation of the actuator causes the backing plate to pivot, thereby causing the latch to rotate between the locked position and the unlocked position;

a key cylinder having a cylinder which rotates about a cylinder axis; and a cam coupled to the cylinder and offset from the cylinder axis, the cam disposed within the T-shaped slot of the backing plate such that rotation of the cam via rotation of the cylinder causes the backing plate to pivot thereby causing the latch to rotate between the locked position and the unlocked position, wherein the cam pushes the backing plate when the cam is positioned within the line portion of the T-shaped slot and the cam does not push the backing plate when the cam is positioned within the crossing portion of the T-shaped slot;

a secondary latch assembly integrated with the door frame; and a linkage including a flat bar portion and projections extending from respective one of each of two longitudinal sides of the flat bar portion, wherein the linkage operably connects the primary and secondary latch assemblies such that the latch assemblies operate substantially in unison wherein each projection includes an ear extending perpendicularly therefrom, wherein the ears are attached to the secondary latch assembly and configured to urge the link away from the secondary latch assembly and towards the door frame.

2. A latch assembly for securing a door to a door frame, the latch assembly comprising:

a latch rotatable between a locked position in which the latch is in an extended position configured to engage the door frame and an unlocked position in which the latch is in a retracted position configured to be disengaged from the door frame;

a pivoting backing plate operably coupled to the latch such that pivoting of the backing plate causes the latch to rotate between the locked position and the unlocked position, the backing plate having a T-shaped slot formed by a crossing portion and a line portion intersecting the crossing portion;

a rotatable actuator operably coupled to a pivoting backing plate such that rotation of the actuator causes the backing plate to pivot, thereby causing the latch to rotate between the locked position and the unlocked position;

a key cylinder having a cylinder which rotates about a cylinder axis; and a cam coupled to the cylinder and offset from the cylinder axis, the cam disposed within the T-shaped slot of the backing plate such that rotation of the cam via rotation of the cylinder causes the backing plate to pivot thereby causing the latch to rotate between the locked position and the unlocked position, wherein the cam pushes the backing plate when the cam is positioned within the line portion of the T-shaped slot and the cam does not push the backing plate when the cam is positioned within the crossing portion of the T-shaped slot.

3. The latch assembly of claim 2, further comprising an actuating arm coupled to both the latch and the actuator for transferring the force of the rotating actuator to the latch.

4. The latch assembly of claim 3, further comprising a pocket configured to be substantially flush-mounted with one side of the door, and wherein the actuator is disposed within the pocket.

5. The latch assembly of claim 4, wherein the key cylinder is configured to mount substantially flush with one side of the door.

6. The latch assembly of claim 5 further comprising two hand pulls configured to mount substantially flush with each side of the door.

7. The latch assembly of claim 6, wherein the hand pulls mount to each side of the door in an offset, interlocking relationship.

8. A latch assembly for securing a door to a door frame, the latch assembly comprising:

a housing;

a latch rotatably coupled to the housing, the latch rotatable between a locked position in which the latch is in an extended position configured to engage the door frame and an unlocked position in which the latch is in a retracted position configured to be disengaged from the door frame;

a pivoting backing plate operably coupled to the latch such that pivoting of the backing plate causes the latch to rotate between the locked position and the unlocked position, the backing plate having a T-shaped slot formed by a crossing portion and a line portion intersecting the crossing portion;

an actuator rotatably coupled to the housing, the actuator operably coupled to a pivoting backing plate such that rotation of the actuator causes the backing plate to pivot, thereby causing the latch to rotate between the locked position and the unlocked position, the pivoting backing plate rotatably coupled to the housing;

a key cylinder attached to the housing, the key cylinder having a cylinder which rotates about a cylinder axis; and a cam coupled to the cylinder and offset from the cylinder axis, the cam disposed within the T-shaped slot of the backing plate such that rotation of the cam via rotation of the cylinder causes the backing plate to pivot thereby causing the latch to rotate between the locked position and the unlocked position, wherein the cam pushes the backing plate when the cam is positioned within the line portion of the T-shaped slot and the cam does not push the backing plate when the cam is positioned within the crossing portion of the T-shaped slot.

9. The latch assembly of claim 8, further comprising an actuating arm coupled to both the latch and the actuator for transferring the force of the rotating actuator to the latch.

10. The latch assembly of claim 9, wherein the actuating arm is rotatably coupled to the frame.

11. The latch assembly of claim 10, further comprising at least one spring configured to bias the actuating arm into a detent position in which the latch is fixed in at least one of the locked position or the unlocked position.

12. The latch assembly of claim 8, further comprising a pocket configured to be substantially flush-mounted with one side of the door, and wherein the actuator is disposed within the pocket.

13. The latch assembly of claim 8, wherein the key cylinder is configured to mount substantially flush with one side of the door.

14. The latch assembly of claim 8, further comprising two hand pulls configured to mount substantially flush with each side of the door.

15. The latch assembly of claim 8, wherein the hand pulls mount to each side of the door in an offset, interlocking relationship.

* * * * *